US006719060B1

(12) United States Patent
Wells

(10) Patent No.: US 6,719,060 B1
(45) Date of Patent: Apr. 13, 2004

(54) PLUNGER LIFT SEPARATION AND CYCLING

(76) Inventor: Edward A. Wells, 14862 Cabo de Bara, Corpus Christi, TX (US) 78418

( * ) Notice: Subject to any disclaimer, the term of this patent is extended or adjusted under 35 U.S.C. 154(b) by 0 days.

(21) Appl. No.: 10/292,238

(22) Filed: Nov. 12, 2002

(51) Int. Cl.[7] ..... E21B 43/00

(52) U.S. Cl. ..... 166/372; 166/153; 166/155

(58) Field of Search ..... 166/105, 153, 166/155, 156, 193, 372, 53, 70; 417/555.2, 552

(56) References Cited

U.S. PATENT DOCUMENTS 2,074,912 A 3/1937 Hutto
3,090,316 A 5/1963 Montgomery
3,968,839 A * 7/1976 Swihart, Sr. ..... 166/250.07
4,502,843 A * 3/1985 Martin ..... 417/56
4,889,473 A * 12/1989 Krueger ..... 417/56
4,923,372 A * 5/1990 Ferguson et al. ..... 417/53
6,045,335 A * 4/2000 Dinning ..... 417/59
6,148,923 A 11/2000 Casey
6,209,637 B1 4/2001 Wells
6,467,541 B1 10/2002 Wells

* cited by examiner

*Primary Examiner*—Frank Tsay
(74) *Attorney, Agent, or Firm*—G. Turner Moller

(57) ABSTRACT

A plunger lift for a hydrocarbon well includes a multipart piston that is dropped into the well in separate pieces. When the pieces reach the bottom of the well, they fall into an accumulation of the formation liquid in the bottom of the well and unite. Gas from the formation pushes the unit upwardly, pushing liquid above the piston toward the surface. The multipart piston includes a upper sleeve and a lower component. A decoupler at the surface comprises a separator rod which the sleeve passes onto thereby dislodging the lower component and allowing it to fall into the well. The sleeve is held on the separator rod by the action of well contents flowing around and/or through the sleeve. When well flow around the sleeve is interrupted, the sleeve falls into the well. The length of time the sleeve is held at the surface is varied in response to the amount of liquid produced on each cycle.

27 Claims, 4 Drawing Sheets

PLUNGER LIFT SEPARATION AND CYCLING

This invention relates to a plunger lift for moving liquids upwardly in a hydrocarbon well and more particularly to an improved approach for separating the components of a multipart piston at the surface and an improved approach for cycling the piston.

BACKGROUND OF THE INVENTION

There are many different techniques for artificially lifting formation liquids from hydrocarbon wells. Reciprocating sucker rod pumps are the most commonly used because they are the most cost effective, all things considered, over a wide variety of applications. Other types of artificial lift include electrically driven down hole pumps, hydraulic pumps, rotating rod pumps, free pistons or plunger lifts and several varieties of gas lift. These alternate types of artificial lift are more cost effective than sucker rod pumps in the niches or applications where they have become popular. One of these alternative types of artificial lift is known as a plunger lift, which is basically a free piston that moves upwardly in the well to move formation liquids to the surface. Typically, plunger lifts are used in gas wells that are loading up with formation liquids thereby reducing the amount of gas flow.

Gas wells reach their economic limit for a variety of reasons. A very common reason is the gas production declines to a point where the formation liquids are not readily moved up the production string to the surface. Two phase upward flow in a well is a complicated affair and most engineering equations thought to predict flow are only rough estimates of what is actually occurring. One reason is the changing relation of the liquid and of the gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows down below some critical values, or stops, the liquid runs down the inside of the flow string and accumulates in the bottom of the well.

If sufficient liquid accumulates in the bottom of the well, the well is no longer able to flow because the pressure in the reservoir is not able to start flowing against the pressure of the liquid column. The well is said to have loaded up and died. Years ago, gas wells were plugged much quicker than today because it was not economic to artificially lift small quantities of liquid from a gas well. At relatively high gas prices, it is economic to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle. For example, the first technique is to drop soap sticks into the well. The soap sticks and some agitation cause the liquids to foam. The well is then turned to the atmosphere and a great deal of foamed liquid is discharged from the well. Later in its life cycle, when soaping the well has become much less effective, a string of 1" or 1½" tubing is run inside the production string. The idea is that the upward velocity in the small tubing string is much higher which keeps the liquid moving upwardly in the well to the surface. A rule of thumb is that wells producing enough gas to have an upward velocity in excess of 10'/second will stay unloaded. Wells where the upward velocity is less than 5'/second will always load up and die.

As some stage in the life of a gas well, these techniques no longer work and the only approach left to keep the well on production is to artificially lift the liquid with a pump of some description. The logical and time tested technique is to pump the accumulated liquid up to the tubing string with a sucker rod pump and allow produced gas to flow up the annulus between the tubing string and the casing string. This is normally not practical in a 2⅞" tubingless completion unless one tries to use hollow rods and pump up the rods, which normally doesn't work very well or very long. Even then, it is not long before the rods cut a hole in the 2⅞" string and the well is lost. In addition, sucker rod pumps require a large initial capital outlay and either require electrical service or elaborate equipment to restart the engine.

Free pistons or plunger lifts are another common type of artificial pumping system to raise liquid from a well that produces a substantial quantity of gas. Conventional plunger lift systems comprise a piston that is dropped into the well by stopping upward flow in the well, as by closing the wing valve on the well head. The piston is often called a free piston because it is not attached to a sucker rod string or other mechanism to pull the piston to the surface. When the piston reaches the bottom of the well, it falls into the liquid in the bottom of the well and ultimately into contact with a bumper spring, normally seated in a collar or resting on a collar stop. The wing valve is opened and gas flowing into the well pushes the piston upwardly toward the surface, pushing liquid on top of the piston to the surface. Although plunger lifts are commonly used devices, there is as much art as science to their operation.

A major disadvantage of conventional plunger lifts is the well must be shut in so the piston is able to fall to the bottom of the well. Because wells in need of artificial lifting are susceptible to being easily killed, stopping flow in the well has a number of serious effects. Most importantly, the liquid on the inside of the production string falls to the bottom of the well, or is pushed downwardly by the falling piston. This is the last thing that is desired because it is the reason that wells load up and die. In response to the desire to keep the well flowing when a plunger lift piston is dropped into the well, attempts have been made to provide valved bypasses through the piston which open and close at appropriate times. Such devices are to date quite intricate and these attempts have so far failed to gain wide acceptance.

A more recent development is of multi-part plungers which may be dropped into a well while formation contents are flowing upwardly in the well as shown in U.S. Pat. Nos. 6,148,923, 6,209,637 and 6,467,541.

SUMMARY OF THE INVENTION

In this invention, an improved technique is used to hold part of a multipart piston at the surface. Flow of formation contents is directed upwardly around and/or through a sleeve comprising part of the piston to produce a pressure drop across the sleeve sufficient to hold the sleeve in the wellhead and offset gravity. The sleeve is released by momentarily interrupting flow from the well, as by the use of a motorized wing valve on the well head. As soon as flow is interrupted, the pressure drop across the sleeve disappears and the sleeve falls into the well.

In another aspect of this invention, a sensor is used to detect liquid flow, as opposed to gas flow and a parameter or value is obtained that is proportional to the amount of liquid being ejected from the well by the free piston. If the amount of liquid is smaller than desired, part of the multipart piston is retained in the well head a little longer time than previously. If the amount of liquid is larger than desired, part of the multipart piston is retained in the well head a little shorter time than previously. It is desired to retrieve a small quantity of liquid on each trip of the free piston, typically on the order of ⅛ to ½ barrel per trip.

It is an object of this invention to provide an improved plunger lift.

A more specific object of this invention is to provide an improved separator for a multipart piston of a plunger lift that acts to hold a plunger sleeve and release it without moving parts acting on the plunger.

A further object of this invention is to provide an improved technique for determining when to drop the sleeve of a multipart piston.

These and other objects of this invention will become more fully apparent as this description proceeds, reference being made to the accompanying drawings and appended claims.

DETAILED DESCRIPTION

Figure 1:
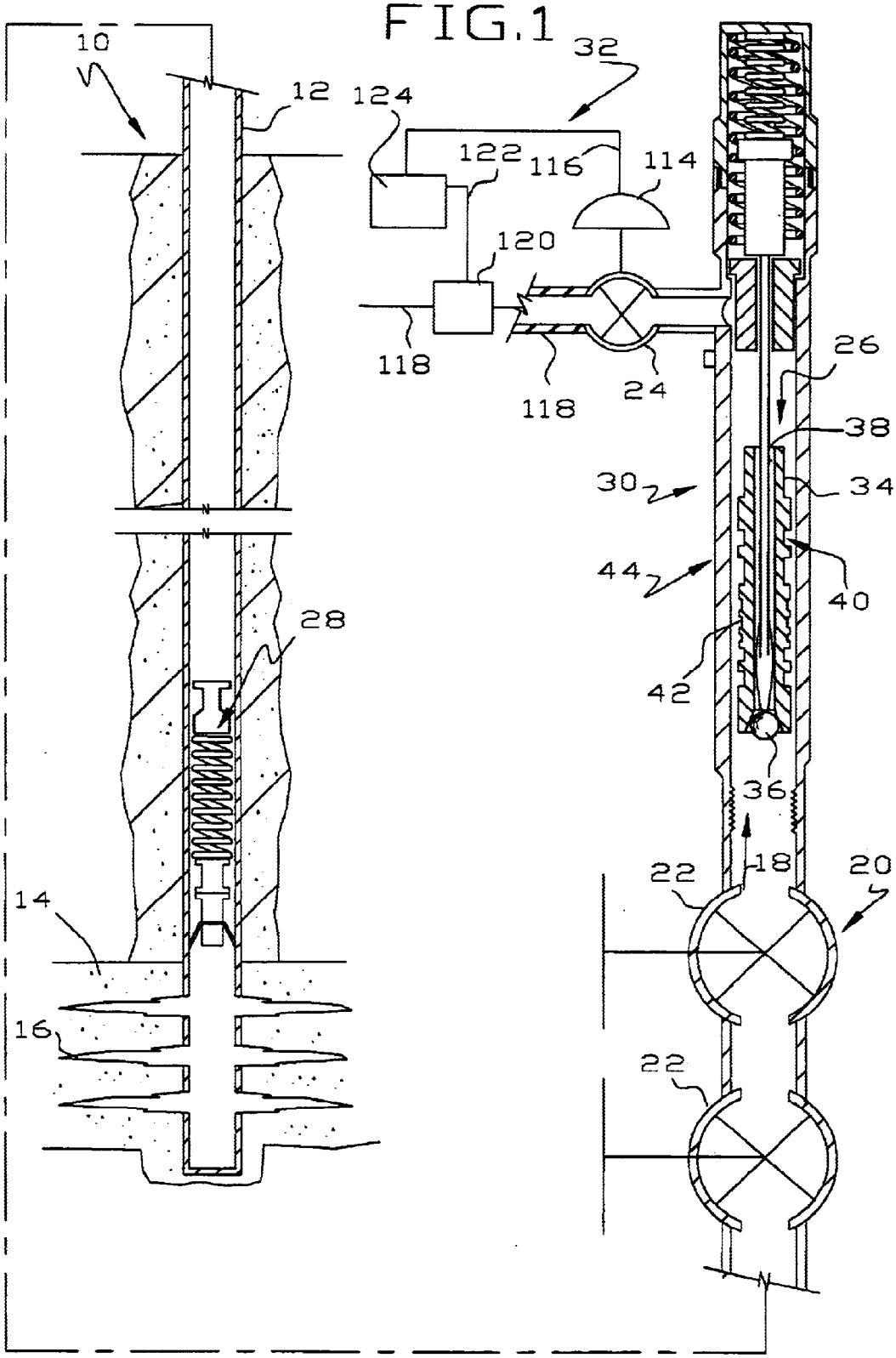
FIG. 1 is a schematic view of a well equipped with a plunger lift system of this invention, certain parts being broken away for clarity of illustration.
Figure 2:
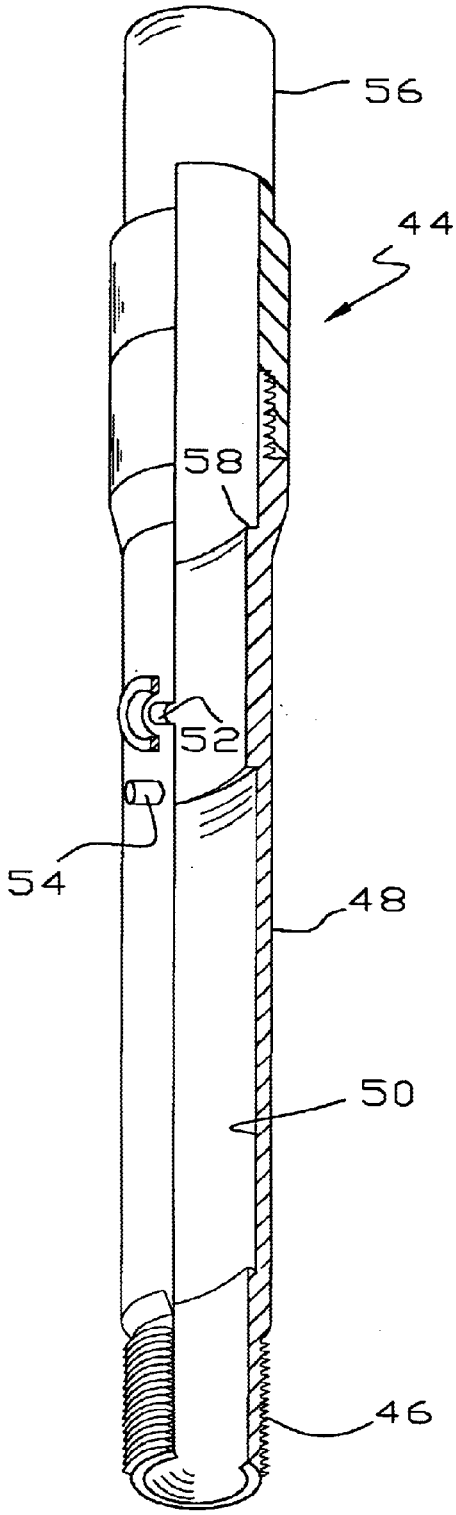
FIG. 2 is an enlarged broken view of a housing or catch tube placed on the top of a well head.

The multipart plunger shown in U.S. Pat. No. 6,467,541 has proven to be quite satisfactory for a wide range of applications where gas wells produce sufficient liquid that slows down gas production and ultimately kills the well. Experience and analysis suggests two improvements which may be made in the operation of a multipart plunger.

In this invention, the technique used to separate and hold the plunger at the surface employs moving parts to receive and cushion the impact of the plunger as it arrives at the surface but employ no moving parts to hold the plunger in the well head. A separator rod is provided which the plunger sleeve slides over, thereby dislodging the lower plunger component and causing the lower component to fall into the well. Flow from the well passes around and/or through the separator rod and the plunger sleeve. The separator rod and plunger sleeve include cooperating sections that produce a pressure drop sufficient to hold the plunger sleeve in the well head against the force of gravity. When flow through the well head is insufficient to hold the plunger sleeve against the force of gravity, the plunger sleeve falls into the well, couples with the lower plunger component near the bottom of the well and then moves upwardly to produce a quantity of formation liquid thereby unloading the well. Typically, the plunger sleeve is dropped into the well in response to closing of a valve at the surface that interrupts flow thereby momentarily reducing gas flow at the surface and substantially eliminating any pressure drop across the plunger sleeve.

An important advantage of the separator rod of this invention is the plunger sleeve is dropped by momentarily shutting in a valve controlling flow from the well. This allows operation of the plunger lift without using natural gas as a power source for a holding device thereby eliminating the venting of methane to the atmosphere. It also eliminates a holding device which includes moving parts subject to malfunction or failure.

Major gas producing companies that operate large numbers of gas wells have gained considerable experience in keeping older gas wells flowing. Many of such companies use large numbers of plunger lifts and have devised sophisticated computer programs to determine when to drop conventional one-piece plungers into a well. It will be recollected that one-piece plunger are typically held at the surface until production falls off, whereupon the well is shut in, the plunger is released and the well remains shut in for a long enough time for the plunger to fall to the bottom of the well. The flow control valve is then opened and the well produces enough formation contents to drive the plunger to the surface, producing liquid along with gas and thereby unloading the well. The computer programs used to operate conventional one-piece plunger lift systems act in response to a wide variety of input information, e.g. flowing well head pressure or flow line pressure which are either the same or very close to the same, gas volume, pressure on the casing as opposed to pressure of gas flowing in the tubing and previous plunger speed as an indication of the liquid being lifted.

Although they can be made to work satisfactorily with multipart plungers, these conventional programs measure the wrong things to drop a multipart plunger sleeve into a well on an optimum basis. An ideal cycle for a multipart plunger is to lift a small quantity of liquid on each plunger trip. It is not desirable to lift no liquid because the plunger takes a beating when it enters the well head with no liquid in front of it—the piston velocity is too high and the spring assemblies in the well head take too much punishment. More importantly, if no liquid is being lifted, it is quite likely there is no liquid in the bottom of the well. When this happens, there is likely considerable damage done to the bumper assembly at the bottom of the well as may be imagined by considering the damage potential of a metal article weighing a few pounds falling at terminal velocity. When there is no liquid being lifted, the plunger should be dropped less frequently.

Conversely, if the plunger is lifting too large a quantity of liquid on each cycle, the productivity of the well is being unduly restricted. If the quantity of liquid becomes too large, there is a risk that plunger will not cycle and the well will be dead. When the quantity of liquid becomes larger than a small selected value, the plunger should be dropped more frequently. Thus, there is an ideal amount of liquid to be raised on each cycle and it is surprisingly small, something on the order of ⅛ to ⅛ barrel, depending on the flowing bottom hole pressure of the well and the flow line pressure the well is producing against. In normal situations, a preferred amount being lifted on each cycle of the plunger is on the order of about ⅙ barrel. Thus, by measuring what is important to the operation of a multipart piston of a plunger lift, improved operations result.

Thus, one aspect of this invention is to measure the quantity of liquid produced on each cycle of operation and adjust the time in which the plunger sleeve is at the surface in response to the measured liquid. For example, if the amount of liquid is larger than a selected value, the time between drops is shortened and if the amount of liquid is smaller than a selected value, the time between drops is lengthened.

Referring to FIGS. 1–5, a hydrocarbon well 10 comprises a production string 12 extending into the earth in communication with a subterranean hydrocarbon bearing formation 14. The production string 12 is typically a conventional tubing string made up of joints of tubing that are threaded together. Although the production string 12 may be inside a casing string (not shown), it is illustrated as cemented in the earth. The formation 14 communicates with the inside of the production string 12 through perforations 16. As well be more fully apparent hereinafter, a plunger lift 18 is used to lift oil, condensate or water from the bottom of the well 10 which may be classified as either an oil well or a gas well.

In a typical application of this invention, the well 10 is a gas well that produces some formation liquid. In an earlier stage of the productive life of the well 10, there is sufficient gas being produced to deliver the formation liquids to the surface. The well 10 is equipped with a conventional well head assembly 20 comprising a pair of master valves 22 and a wing valve 24 delivering produced formation products to a surface facility for separating, measuring and treating the produced products.

The plunger lift 18 of this invention comprises, as major components, a piston 26, a lower bumper assembly 28 near the producing formation 14, a catcher assembly 30 and an assembly 32 for controlling the cycle time of the piston 26.

The piston 26 is of multipart design as shown in U.S. Pat. No. 6,209,637 or preferably as shown in U.S. Pat. No. 6,467,541, the disclosures of which are incorporated herein by reference, to which reference for a more complete description thereof. The piston 26 includes an upper sleeve 34 and a lower component 36 which may be of cylindrical shape as shown in U.S. Pat. No. 6,209,637 but which is preferably a ball as shown in U.S. Pat. No. 6,467,541.

The sleeve 34 is generally cylindrical having an interior flow passage 38 and a seal arrangement 40 to minimize liquid on the outside of the sleeve 34 from bypassing around the exterior of the sleeve 34. The seal arrangement 40 may be of any suitable type, such as wire brush wound around the sleeve 34 providing a multiplicity of bristles or the like or may comprise a series of simple grooves or indentations 42. The grooves 42 work because they create a turbulent zone between the sleeve 34 and the inside of the production string 12 thereby restricting liquid flow on the outside of the sleeve 34.

As will be more fully apparent hereinafter, the ball 36 is first dropped into the well 10, followed by the sleeve 34. The ball 36 and sleeve 34 accordingly fall separately and independently into the well 10, usually while the well 10 is producing gas and liquid up the production string 12 and through the well head assembly 20. When the ball 36 and sleeve 34 reach the bottom of the well, they impact the lower bumper assembly 28 in preparation for moving upwardly.

The lower bumper assembly 28 may be of any suitable design, one of which is illustrated in U.S. Pat. No. 6,209,637 and basically acts to cushion the impact of the ball 36 and sleeve 34 when they arrive at the bottom of the well 10.

An important feature of this invention is the catcher assembly 30 which has several functions, i.e. separating the ball 36 from the sleeve 34, retaining the sleeve 34 in the assembly 30 for a period of time and then dropping the sleeve 34 into the well 10. The catcher assembly 30 comprises an outer housing or catch tube 44 having a threaded lower end 46 for attachment to the well head 20, simply by screwing the housing into an upwardly facing collar or other fitting on the well head 20. The sleeve 34 comes to rest in a lower portion 48 of the housing 44 and is spaced from an inner passage 50 to provide a flow path around the outside of the sleeve 34. A central part of the housing 44 provides an outlet 52 for formation products and an interiorly threaded fitting 54 for receiving a needle valve, pressure gauge or the like. The upper part of the housing 44 comprises a removable cap 56 providing access to the internal components of the catcher assembly 30. A shoulder 58 provides a stop for purposes more fully apparent hereinafter.

Inside the housing 44 is a rod assembly 60 comprising a separation rod 62 and an annular anvil 64 slidably mounted on the upper end of the separation rod 62 and a pair of springs 66, 68 for cushioning the impact of the sleeve 34, and to some extent of the ball 36, when the piston 26 reaches its upper limit of travel. The separation rod 62 includes an elongate lower end 70 for receiving the sleeve 34, an intermediate section 72 of somewhat larger diameter and a collar or shoulder 74 near the upper rod end and a stub 76 extending into the spring 66.

The annular anvil 64 has a lower end 78 providing a slot 80 allowing the exit of formation products to the outlet 52 of the housing 44. An intermediate section of the anvil 64 provides a collar or shoulder 82 which abuts the spring 68 on one side and the shoulder 58 of the housing 44 on the other, thereby captivating the anvil 64 inside the housing 44 and allowing limited movement as retarded by the spring 68. The collar 82 includes a vertical outside passage 84 allowing liquid movement around the collar 82 and minimizing a tendency of the anvil 64 to oscillate when liquid is passing through the housing outlet 52. The anvil 64 includes an upwardly facing annular shoulder 86 which abuts the collar 74 at the end of the separator rod 62. The anvil 64 includes a central passage 88 receiving an intermediate section of the separator rod 62.

When the piston 26 rises in the production string 12 and approaches the well head 20, a liquid head above the piston 26 is pushed through the housing 44 and around the rod assembly 60 to exit through the outlet 52. The sleeve 34 ultimately passes onto the lower end of the separator rod 62 thereby dislodging the ball 36 and allowing it to fall immediately back into the production string 12. The separator rod 62 is cushioned against impact from the ball 36 or from a glancing blow from the sleeve 34 by the spring 66. When the sleeve 34 strikes the anvil 64, the impact is cushioned by the spring 68. The exterior passage 84 allows liquid movement above and below the collar 82 so there is a much lesser tendency of the anvil 64 to oscillate due to pressure changes across the collar 82.

An important feature of this invention is that the sleeve 34 is held in the well head 20 against gravity by a pressure drop induced from formation contents flowing upwardly through the well head 20. To this end, the sleeve 34 is held below, or at least partially below, the outlet 52 provided by the housing 44. Formation products accordingly flow between the separation rod 62 and the inside of the sleeve 34 and between the outside of the sleeve 34 and the passage 50. The pressure drop across the sleeve 34 acting on the cross-sectional area of the sleeve 34 is sufficient to hold the sleeve 34 against gravity in accordance with the equation $F=pa$ where F is the upward force on the sleeve 34, p is the pressure drop across the sleeve 34 and a is the effective cross-sectional area of the sleeve 34.

There are a variety of ways the necessary pressure drop can be created. Theoretically, the pressure drop can be created by a simple cylindrical rod acting through a cylindrical passage in the sleeve. This require fairly close tolerances between the separation rod, the inside of the sleeve, the inside of the housing and certain assumptions about the amount and pressure of the gas flowing through the sleeve. In this circumstance, the sleeve is pushed upwardly against the anvil 64 and held there. When there is a reduction in the upwardly force acting on the sleeve 34 below that sufficient to offset gravity, the sleeve 34 falls into the production string 12. This is not an optimum approach because the flow rate assumption has to be relatively low requiring tolerances to be fairly close meaning that under more normal flow conditions, there may be a larger pressure drop across the piston sleeve 34 than is desirable.

Figure 5:
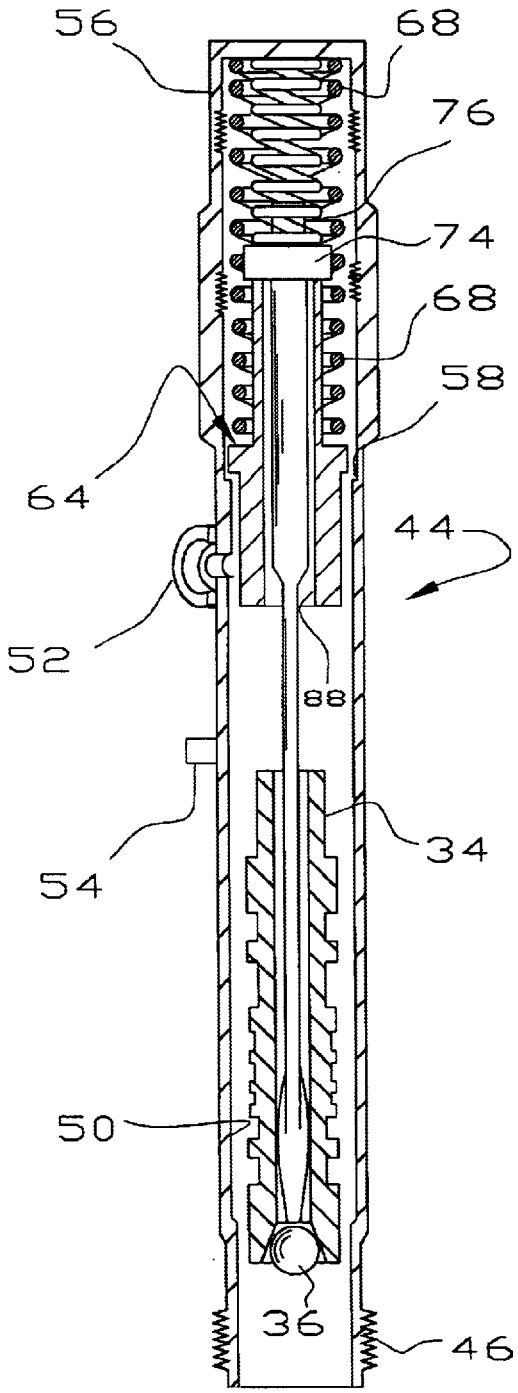
FIG. 5 is a vertical cross-sectional view of the housing and rod assembly showing a relationship between the separator rod and the piston sleeve.
Figure 3:
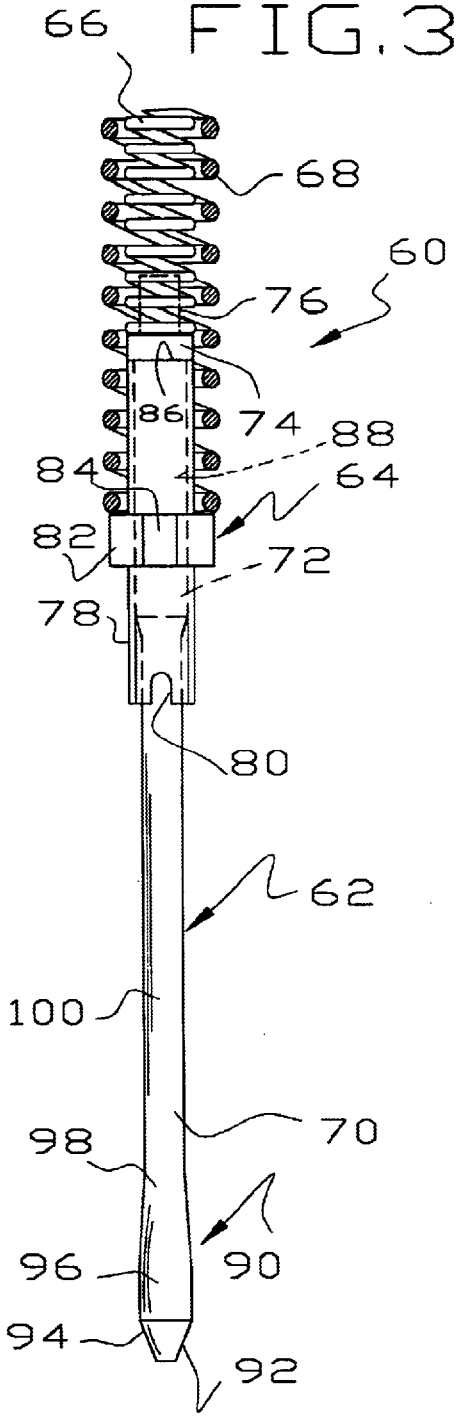
FIG. 3 is an enlarged broken view of a rod assembly rod used to separate the multipart plunger into its component parts.
Figure 4:
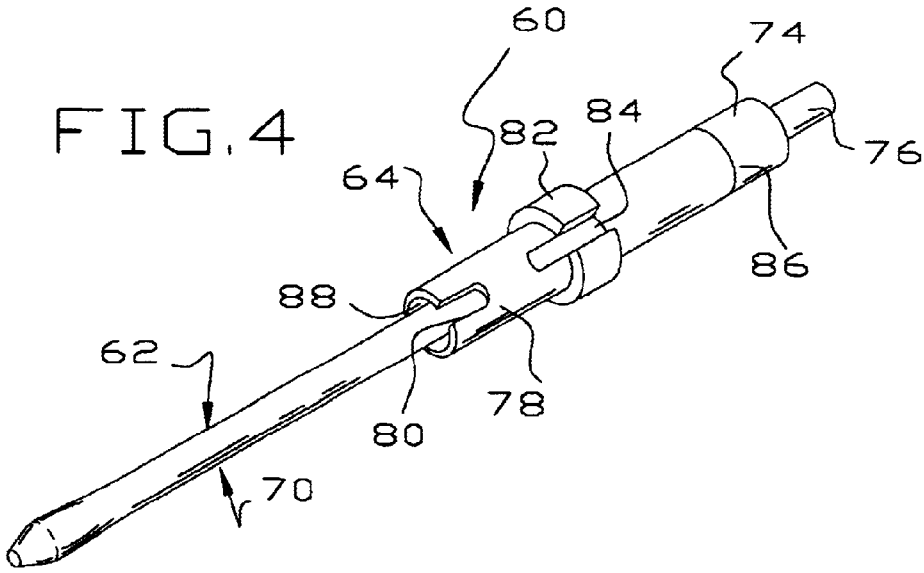
FIG. 4 is an isometric view of part of the rod assembly of FIG. 3.

A preferred approach is shown in FIGS. 3–5 where the separation rod 62 includes a bulge 90 on the lower end 70 of the rod 62 above the lowermost tapered end 92. The bulge 90 includes a maximum diameter 94, a slightly rounded section 96 of the more-or-less constant diameter and a tapered section 98 merging with a main length section 100 of cylindrical shape. The section 100 is preferably longer than the sleeve 34. The function of the bulge 90 is to create the pressure drop necessary to hold the sleeve 34 against gravity. When the piston 26 arrives at the separation rod 62, the ball 36 is dislodged from the bottom of the sleeve 34 by the end 92 of the separation rod 62. The sleeve 34 continues upward movement due to its momentum onto the separation rod 62 and strikes the anvil 64. Arrival of the piston 26 at the well head 20 can be sensed in a variety of ways, one convenient technique being to use a magnet to detect movement of the anvil 64.

The gap between the main length section 100 and the inside of the sleeve 34 is insufficient to hold the sleeve 34 against gravity at any reasonable flow rate so the sleeve 34 immediately falls toward the end of the separation rod 62. As the inside of the sleeve 34 passes onto the tapered section 98, the flow path between the sleeve 34 and the section 98 beings to decrease because of the taper. When the sleeve 34 passes onto the section 96, the flow path between the sleeve 34 and the section 96 decreases to a minimum, which is sufficient to create the pressure drop necessary to hold the sleeve 34 against gravity.

The axial length of the section 96 allows the sleeve 34 to oscillate up and down, changing the length of the restricted flow path between the sleeve 34 and the section 96 in response to changing flow conditions thereby maintaining the pressure drop across the sleeve 34 at a value sufficient to keep the sleeve 34 in the catcher 44. Thus, the maximum pressure drop across the sleeve 34 occurs when all of the section 96 and all of the section 98 are inside the sleeve 34. If this produces too great a pressure drop, the sleeve 34 moves upwardly, coming at least partially off the section 96, decreasing the length of the flow restriction between the sleeve 34 and the section 96 and reducing the pressure drop, allowing the sleeve 34 to be balanced against upward flow in the well head 20. Thus, the sleeve 34 tends to oscillate up and down on the rod 62 in response to varying flow conditions in the production string 12 and produces a minimum pressure drop sufficient to hold the sleeve 34 against gravity, as compared to the situation where the rod 62 and sleeve passage 38 are constant.

Other techniques will be apparent to those skilled in the art to produce a pressure drop across the sleeve 34 and thereby hold the sleeve 34 against gravity. In the embodiment of FIGS. 1–5, thee is a flow path of varying cross-section between the separator rod 62 and the sleeve 34 and a flow path of constant cross-section between the sleeve 34 and the housing 44. Rather than make the variable flow path between the separator rod 62 and the sleeve 34, the variable flow path may be designed between the sleeve 34 and the housing 44.

Figure 6:
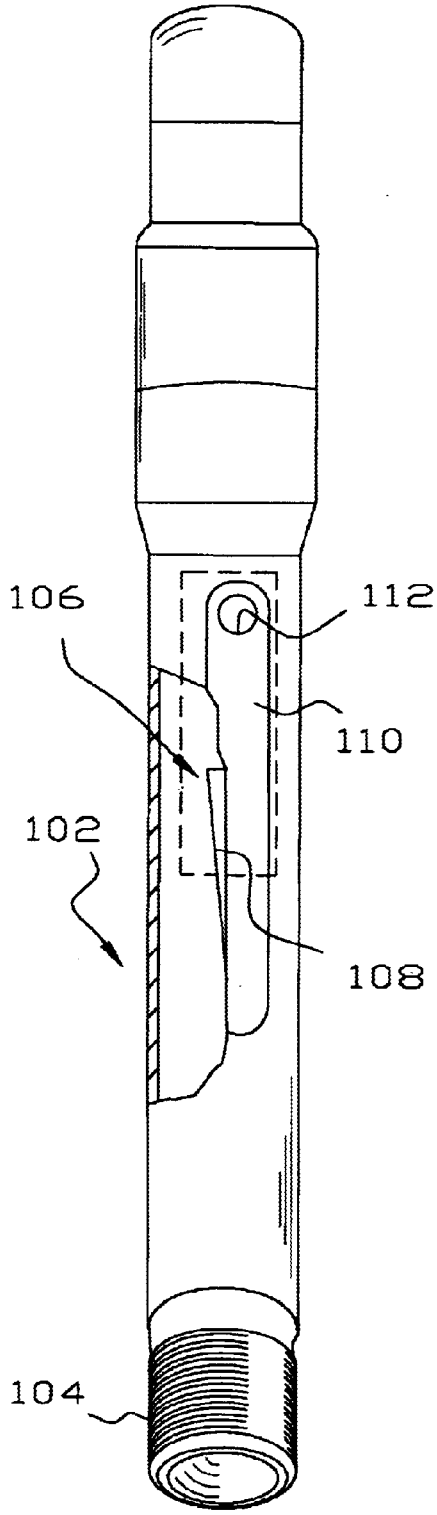
FIG. 6 is view similar to FIG. 2 showing an adjustable flow path between the piston sleeve and the housing.

Referring to FIG. 6, one approach to this end is illustrated. A housing or catch tube 102 provides a threaded lower end 104 for attachment to the well head 20, simply by screwing the housing into an upwardly facing collar or other fitting on the well head 20. The outlet 106 from the housing 102 is an upwardly diverging slot 108 opening into a pouch or enlargement 110 welded on the side of the housing 102 and having an outlet opening or nipple 112 for connection to a flow line. A rod assembly (not shown) which may comprise a cylindrical separator rod fits inside the housing 102 to dislodge the ball 36 and hold the sleeve 34 for vertical movement inside the housing 102. As the sleeve 34 moves upwardly, the effectively size of the outlet slot 108 increases thereby reducing the pressure drop across the sleeve 34. In the event well flow subsides somewhat, the sleeve 34 moves downwardly thereby closing off part of the slot 108 and increasing the pressure drop across the sleeve 34 and raising the sleeve 34. It will accordingly be seen that the slot 108 and housing 102 of FIG. 6 work in substantially the same manner as the bulge 90 of the separator rod 62.

Referring to FIG. 1, the piston sleeve 34 is dropped into the production string 12 simply by momentarily closing the wing valve 24. This may be automated by providing a motor operator 114 and controlling the operator 114 by an electrical signal delivered through a wire 116. Although any suitable controller may be used to cycle the plunger lift of this invention, a preferred technique is to measure or sense liquid delivered through a flow line 118 leading from the wellhead 20 and momentarily close the valve 24 in response to a parameter related to the amount of liquid flowing in the flow line 118.

To this end, a sensor 120 is provided in the flow line 118 providing a signal on a wire 122 leading to a controller 124. The sensor 120 may be of any suitable type that is capable of distinguishing between gas and liquid moving in the flow line 118 and providing an output representative of the amount of liquid being produced. One suitable type of sensor 120 is a flow meter known as a target flow meter. These meters are commercially available from Hersey Measurement Company, Spartenburg, S.C. or Franklin General Technologies Corp. West Edinboro, Pa. These type flow meters have a paddle extending into the flow path of the well stream which is impacted by the well contents.

The force acting on the paddle is measured with a strain gauge. The force is $F=(V^2/2g)pCda$ where V is the velocity of the well stream, g is the force of gravity, p is the density of the liquid or gas, Cd is the drag coefficient of the paddle and A is the area of the paddle. When comparing the force generated on the paddle by liquid and gas, the equation reduces to $F_1/F_g=p_1/p_g$ where $F_1$ is the force produced by liquid on the paddle, $F_g$ is the force produced by gas on the paddle, $p_l$ is the density of the liquid and $p_g$ is the density of the gas. Because the density of the liquid, even if it is gas cut, is much larger than the density of dry gas at flowing pressures less than 100 psig, target mass flow meters can readily distinguish between gas and liquid moving in the flow line 118. In the event the target flow meter 120 measured an amount of liquid above a selected value, e.g. ⅙ barrel, the controller 124 acts to reduce the time in which the sleeve 34 is held in the well head 20 and then sends a signal over the wire 116 to momentarily close the valve 24. If the target flow meter 120 measures an amount of liquid below the selected value, the controller 124 acts to increase the time in which the sleeve 34 is held in the well head 20 and then sends a signal over the wire 116 to momentarily close the valve 24.

Figure 7:
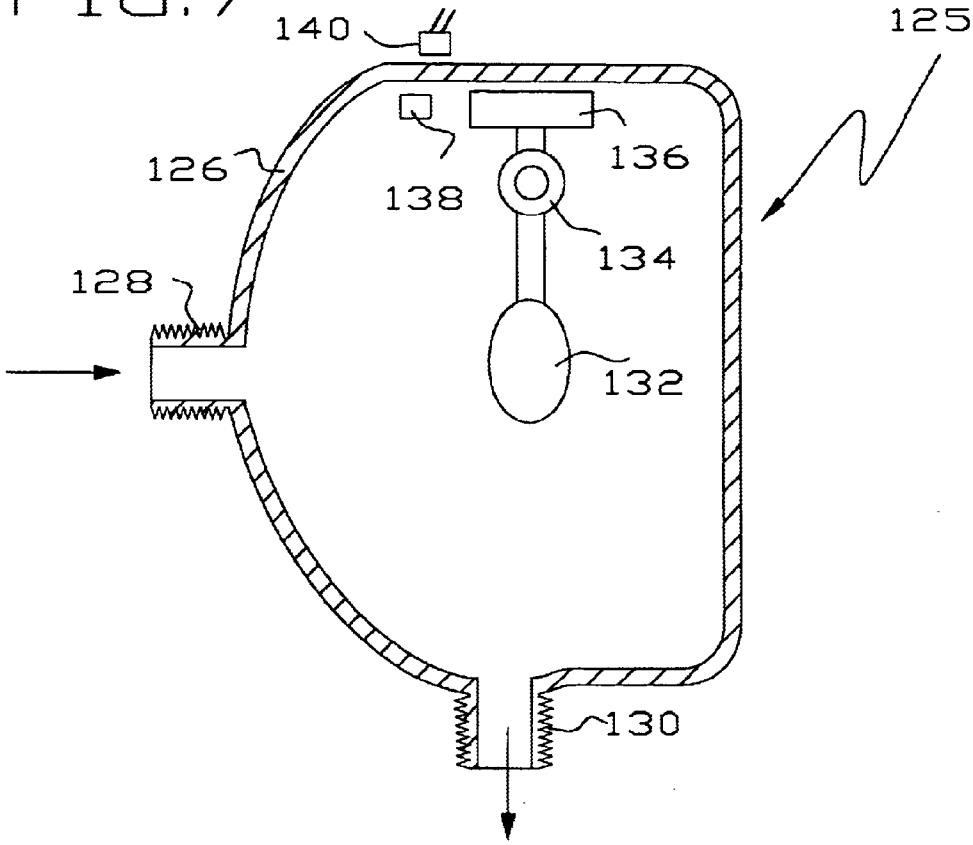
FIG. 7 is a broken view of one type of mass flow sensor used to cycle the multipart plunger of this invention.

Commercially available target flow meters are somewhat expensive because they are designed to produce accurate measures of mass flow. In this invention, great accuracy is not required. Another type sensor that is suitable for use in this invention is a low cost liquid detector 125 is shown in FIG. 7 comprising a housing 126 having an inlet 128 and an outlet 130 which may be coaxial rather than as illustrated. The housing 126 is conveniently but not necessarily of an non-magnetic material such as aluminum or some steel alloys for purposes more fully apparent hereinafter. A target or paddle 132 is positioned in front of the inlet 128 so that gas and liquid impact the target 132. The target 132 is pivoted by a suitable support 134 and carries a detectable element 136 for movement from a normal vertical position to a position against a stop 138. The arrival and departure of the element 136 at the stop 138 is detected in any suitable manner, as by the provision of a magnetic pickup 140 on the outside of the housing 126.

If the housing 126 is non-magnetic and the element 136 is steel or another magnetically affected composition, the position of the element 136 is easily detected by the pickup 140. The target 132 may be weighted or may act against a spring to produce a situation where there is little or no movement of the target 132 so long as gas is flowing inside the housing 126. When liquid exits from the inlet 128 and strikes the target 132, the target pivots against the stop 138 and this is detected by the pickup 138. When liquid flow through the detector 125 stops, the target 132 returns to its normal position and the pickup 140 detects movement away from the stop 138. The stop 138 and/or the target 132 may be dampened by a spring, hydraulic damper or other suitable device so the target 132 doesn't overly oscillate. Thus, when using the detector 125, a likely parameter used by the controller 124 to control cycling of the piston sleeve 34 is the time during which the detectable element 136 is against the stop 138 or is moved away from its normal position.

There are many flow meters that operate on substantially different principles to distinguish between gases and liquids. Some of these operate on principles as different as magnetics and Coriolis forces. Any flow meter or flow detector that is capable of distinguishing between gases and liquids is suitable for the practice of this invention.

Operation of the plunger lift of this invention should now be apparent. During upward movement of the piston 26 toward the well head 20, production through the wing valve 24 is mainly dry gas. As the piston 26 approaches the well head, there is often a small slug or batch of liquid that passes through the wing valve 24 which may cause the meter 120 or detector 125 to detect the arrival of a liquid slug at the surface. If the amount of liquid is very small, it can be readily identified and disregarded by the controller 124. As the piston 26 nears the well head 20, it pushes a quantity of liquid above it through the well head and the wing valve 24 to be measured or sensed by the meter 120 or the detector 125. If the plunger lift is working satisfactorily, the volume immediately above the piston 26 is a more-or-less solid stream of liquid, the volume or time of discharge of which is measured by the meter 120 or the detector 125.

When the piston 26 reaches the separation rod 62, the ball 36 is dislodged from the piston 26 and falls immediately back into the production string 12. The sleeve 34 slips over the separation rod 62 and strokes the anvil. Any liquid remaining in the well head is driven through the flow line 118 by formation gas. Gas flowing upwardly in the flow paths around the separation rod 62, sleeve 34 and housing 44 creates a pressure drop across the sleeve 34 causing it to stay on the rod 62 against the effect of gravity. When the controller 124 determines that it is time to drop the sleeve 34 and initiate another plunger cycle, a signal is delivered on the wire 116 to energize the motor operator 114 and momentarily close the wing valve 24. This causes the pressure drop across the sleeve 34 to decrease, so that upward force acting on the sleeve 34 drops and the sleeve 34 falls into the production string.

It will accordingly be seen that the sleeve 34 is held in the well head against the effect of gravity by upward flow in the housing 44 without the use of some mechanism that grips the sleeve 34 or projects into the path of movement of the sleeve 34 from the outside of the housing 44. It will also be seen that cycling the sleeve 34 in response to the amount of liquid delivered during the surface allows a relatively small volume of liquid to be produced during each cycle of the piston 26. This prevents damage to the rod assembly 60 and to the downhole bumper assembly 28 caused by the production of no liquid and allows maximum trouble free gas production by keeping the well unloaded to as great an extent as reasonable.

Occasionally, one needs to recover both the sleeve 34 and the ball 36, for example, in order to inspect or replace them. This is simple to do by waiting until the sleeve 34 has been released and fallen into the well. The well is shut in momentarily by closing one of the master valves 22. The cap 56 is removed, the spring 66 is removed, the separation rod 62 is removed, the cap 56 is replaced and the master valve 22 reopened so the well 10 is placed back on production. When the plunger 26 enters the catcher 44, the master valve 22 is closed, thereby captivating the plunger 26.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A plunger lift for a well producing through a production string communicating with a hydrocarbon formation, comprising a free piston having at least two sections, movable independently downwardly in the well, the sections comprising a lower component and a sleeve providing a seating surface for receiving the lower component so the lower component and sleeve join together in the well for pushing liquid, above the piston, upwardly and a catcher assembly on the well at the surface comprising a housing, a separator rod in the housing for receiving the sleeve thereon and dislodging the lower component, the housing, rod and sleeve providing therebetween flow passes for formation contents, at least one of the flow passages being of variable cross-sectional size producing a pressure drop sufficient to hold the sleeve in the housing against gravity.

2. The plunger lift of claim 1 wherein the flow passages comprise a flow passage of variable cross-sectional size between the rod and the sleeve.

3. The plunger lift of claim 2 wherein the sleeve provides a cylindrical passage therethrough and the rod provides a bulging section, the bulging section and the cylindrical passage providing the flow passage of variable cross-sectional size.

4. The plunger lift of claim 3 wherein the flow passage comprise a flow passage between the sleeve and the housing.

5. The plunger lift of claim 1 wherein the flow passages comprise a flow passage of variable cross-sectional size between the sleeve and the housing.

6. The plunger lift of claim 1 wherein the variable cross-sectional flow passage comprises an outlet in the housing of upwardly increasing size.

7. The plunger lift of claim 1 wherein the catcher assembly is free of components projecting through the housing into a path of downward movement of the piston sleeve.

8. A plunger lift for a well producing through a production string communicating with a hydrocarbon formation, comprising a free piston having at least two sections, movable independently downwardly in the well, the sections comprising a lower component and a sleeve providing a seating surface for receiving the lower component so the lower component and sleeve join together in the well for pushing liquid, above the piston, upwardly and a catcher assembly on the well at the surface comprising a housing, a separator rod in the housing for receiving the sleeve thereon and dislodging the lower component, the housing, rod and sleeve providing therebetween flow passages for formation contents producing a pressure drop sufficient to hold the sleeve in the housing against gravity, the housing providing a path of falling movement for the sleeve to fall into the production string, the catcher assembly being free of components extending into the path of falling movement for retaining the sleeve in the housing.

9. A plunger lift well head assembly for a well producing through a production string communicating with a hydrocarbon formation, comprising a housing having an inlet at an end for receiving flow from the formation and an outlet spaced from the end;

a separator rod in the housing having a free end pointed in the direction of the inlet for receiving a sleeve of a multipart piston and dislodging a lower component of the piston, the separator rod, the housing and the sleeve providing flow passages to the outlet, at least one of the flow passages being of variable cross-sectional size producing a pressure drop sufficient to hold the sleeve in the housing against gravity.

10. The plunger lift of claim 9 wherein the flow passages comprise a flow passage of variable cross-sectional size between the rod and the sleeve.

11. The plunger lift of claim 10 wherein the sleeve provides a cylindrical passage therethrough and the rod provides bulging section, the bulging section and the cylindrical passage providing the flow passage of variable cross-sectional size.

12. The plunger lift of claim 11 wherein the flow passages comprises a flow passage between the sleeve and the housing.

13. The plunger lift of claim 9 wherein the flow passages comprise a flow passage of variable cross-sectional size between the sleeve and the housing.

14. The plunger lift of claim 9 wherein the variable cross-sectional flow passage comprises an outlet in the housing of upwardly increasing size.

15. A plunger lift well head assembly for a well producing through a production string communicating with a hydrocarbon formation, comprising a housing having an inlet at an end for receiving flow from the formation and an outlet spaced from the end;

a separator rod in the housing having a free end pointed in the direction of the inlet for receiving a sleeve of a multipart piston and dislodging a lower component of the piston, the separator rod, the housing and the sleeve providing flow passages to the outlet, at least one the flow passages having a first section and a second section, more restricted than the first section, the second section being below the first section so that upon a lessening of flow through the housing, the sleeve moves downwardly from the first section to the second section and decreases a flow passage thereby maintaining a pressure drop across the sleeve sufficient to hold the sleeve against gravity.

16. A plunger lift for a well producing through a production string communicating with a hydrocarbon formation, comprising a multipart piston movable upwardly in the production string for pushing liquid, above the piston, upwardly, a catcher on the well at the surface for receiving and holding at least a part of the piston against gravity, a sensor for detecting liquid flow out of the well, and an assembly dropping the part of the piston into the well in response to detected liquid.

17. The plunger lift of claim 16 wherein the sensor comprises a target mass flow meter having a target and a force measuring assembly for measuring the force applied by formation contents to the target.

18. The plunger lift of claim 16 wherein the sensor comprises a movable target and an assembly for detecting movement of the target in response to liquid impingement on the target.

19. The plunger lift of claim 16 further comprising a controller receiving an input from the sensor and delivering an output to the assembly for dropping the sleeve into the production string.

20. The plunger lift of claim 19 wherein the controller acts to drop the sleeve at a selected time interval and reduces the time interval in the event the amount of liquid detected is greater than a value.

21. The plunger lift of claim 19 wherein the controller acts to drop the sleeve at a selected time interval and increases the time interval in the event the amount of liquid detected is less than a value.

22. A method of lifting liquids from a well producing hydrocarbons from a formation through a well head with a plunger lift having a multipart piston including an upper sleeve and a lower component and a decoupler on the well head for separating the piston into its parts comprising a rod for receiving the sleeve and dislodging the lower component, comprising:

holding the sleeve in the decoupler by passing formation contents upwardly; and then releasing the sleeve and allowing it to fall into the well by restricting flow of formation contents.

23. The method of claim 22 wherein the holding step comprises creating a pressure drop across the sleeve by flowing formation contents upwardly.

24. The method of claim 23 wherein the releasing step comprises closing a valve leading from the well.

25. The method of lifting liquids from a well producing hydrocarbons from a formation through a well head with a plunger lift having a multipart piston movable upwardly in the well for pushing liquid, above the piston, upwardly, and a catcher on the well at the surface for receiving and holding at least a part of the piston against gravity for a selected time, comprising detecting liquid flow out of the well; and dropping the piston part into the well in response to detecting liquid flow.

26. The method of claim 25 wherein the piston part is held for a selected time and the dropping step comprises holding the piston part for less than the selected time in the event the liquid flow out of the well is greater than a selected value.

27. The method of claim 26 wherein the piston part is held for a selected time and the dropping step comprises holding the piston part for more than the selected time in the event the liquid flow out of the well is less than a selected value.

* * * * *

UNITED STATES PATENT AND TRADEMARK OFFICE

CERTIFICATE OF CORRECTION

PATENT NO. : 6,719,060 B1
DATED : April 13, 2004
INVENTOR(S) : Edward A. Wells

It is certified that error appears in the above-identified patent and that said Letters Patent is hereby corrected as shown below:

Column 4,
Line 58, should read -- on the order of 1/8 to 1/2 barrel, depending on the flowing --

Column 7,
Line 67, should read -- ment of FIGS. 1-5, there is a flow path of varying cross --

Column 10,
Line 56, should read -- providing therebetween flow passages for formation contents --

Column 11,
Line 1, should read -- 4. The plunger lift of claim 3 wherein the flow passages --

Signed and Sealed this

Thirty-first Day of May, 2005

JON W. DUDAS
*Director of the United States Patent and Trademark Office*